313-414 SR
4/12/88 OR 4,737,682

United States Patent [19]
Alig et al.

[11] Patent Number: 4,737,682
[45] Date of Patent: Apr. 12, 1988

[54] COLOR PICTURE TUBE HAVING AN INLINE ELECTRON GUN WITH AN EINZEL LENS

[75] Inventors: Roger C. Alig, West Windsor Township, Mercer County, N.J.; David A. New, Manheim Township, Lancaster County, Pa.

[73] Assignee: RCA Corporation, Princeton, N.J.

[21] Appl. No.: 75,784

[22] Filed: Jul. 20, 1987

[51] Int. Cl.[4] ..... H01J 29/62
[52] U.S. Cl. ..... 313/414
[58] Field of Search ..... 313/414

[56] References Cited

U.S. PATENT DOCUMENTS

| | | | |
|---|---|---|---|
| 3,448,316 | 6/1969 | Yoshida et al. | 313/414 X |
| 3,898,521 | 8/1975 | Saito et al. | 315/370 |
| 3,949,262 | 4/1976 | Ohkoshi et al. | 313/414 X |
| 4,178,532 | 12/1979 | Fukuzawa et al. | 313/414 |
| 4,232,246 | 11/1980 | Sakurai et al. | 313/414 |
| 4,429,252 | 1/1984 | Vieland et al. | 313/414 |
| 4,668,892 | 5/1987 | Peels | 313/414 |

*Primary Examiner*—Palmer C. DeMeo
*Attorney, Agent, or Firm*—Eugene M. Whitacre; Dennis H. Irlbeck

[57] ABSTRACT

The present invention provides an improvement in color picture tubes. Such tubes include an electron gun for generating and directing three inline electron beams, a center beam and two side beams, along initially coplanar paths toward a screen of the tube. The gun includes a plurality of spaced electrodes which form a main focus lens for focusing the electron beams. The improvement comprises the plurality of spaced electrodes which form a main focus lens including four electrodes that form an einzel lens in the path of each electron beam. A first einzel lens electrode includes a first portion having three inline apertures that are set back from a second portion having a single large aperture through which all three electron beams pass. A second einzel lens electrode includes a first portion having three inline apertures that are set back from a second portion having a single large aperture through which all three electron beams pass. The second portion of the first einzel lens electrode faces the second portion of the second einzel lens electrode. A third einzel lens electrode includes a first portion having three inline apertures that are set back from a second portion having a single large aperture through which all three electron beams pass. A fourth einzel lens electrode includes a first portion having three inline apertures set back from a second portion having a single large aperture through which all three electron beams pass. The second portion of the third einzel lens electrode faces the second portion of the fourth einzel lens electrode. The first portion of the second einzel lens electrode and the first portion of the third einzel lens electrode face each other and include means for forming a quadrupole lens in the path of each electron beam therebetween.

1 Claim, 5 Drawing Sheets

COLOR PICTURE TUBE HAVING AN INLINE ELECTRON GUN WITH AN EINZEL LENS

This invention relates to color picture tubes having inline electron guns and, particularly, to an inline gun having an einzel lens as a main focus lens and means for providing dynamic astigmatism correction.

An einzel lens, also called a saddle lens or a unipotential lens, is an electrostatic lens formed by three electrodes, a center electrode and two side electrodes. The center electrode is either connected to a ground potential or to a relatively low voltage potential. The two side electrodes are connected to a relatively high potential which usually is the anode potential. The focus of an einzel lens is slightly less sharp than that of a bipotential lens, but the einzel lens has the advantage that it does not require a second high voltage for a focus electrode. Einzel lens electron guns have been commercially used in color picture tubes, such as in the G.E. Portacolor, the RCA 15NP22 and the Sony Trinitron. The RCA 15NP22 had a delta electron gun and the G.E. Portacolor and Sony Trinitron used inline guns. The RCA and G.E. electron guns had individual tubular electrodes as the center and side electrodes in the paths of each electron beam. The Sony electron gun had large tubular electrodes as the center and side electrodes through which the three electron beams passed, crossing over each other at the center of the einzel lens.

One of the factors that makes the cost of color picture tubes higher than that of monochrome tubes is the need for additional X-ray protection in color tubes. Such additional protection is necessary because of the higher anode voltage required in color tubes. For example, intermediate size, e.g., 23 cm to 33 cm diagonal, color tubes are usually run at 22 kV, whereas the same size monochrome tubes are run at 15 kV. This difference in operating voltage requires a considerable difference in the glass composition of the tube bulb.

It is desirable to develop intermediate size color picture tubes that can operate at lower anode voltages, thereby permitting savings in tube construction as well as in receiver circuitry. The present invention provides such improved tube.

SUMMARY OF THE INVENTION

The present invention provides an improvement in color picture tubes. Such tubes include an electron gun for generating and directing three inline electron beams, a center beam and two side beams, along initially coplanar paths toward a screen of the tube. The gun includes a plurality of spaced electrodes which form a main focus lens for focusing the electron beams. The improvement comprises the plurality of spaced electrodes which form a main focus lens including four electrodes that form an einzel lens in the path of each electron beam. A first einzel lens electrode includes a first portion having three inline apertures that are set back from a second portion having a single large aperture through which all three electron beams pass. A second einzel lens electrode includes a first portion having three inline apertures that are set back from a second portion having a single large aperture through which all three electron beams pass. The second portion of the first einzel lens electrode faces the second portion of the second einzel lens electrode. A third einzel lens electrode includes a first portion having three inline apertures that are set back from a second portion having a single large aperture through which all three electron beams pass. A fourth einzel lens electrode includes a first portion having three inline apertures set back from a second portion having a single large aperture through which all three electron beams pass. The second portion of the third einzel lens electrode faces the second portion of the fourth einzel lens electrode. The first portion of the second einzel lens electrode and the first portion of the third einzel lens electrode face each other and include means for forming a quadrupole lens therebetween in the path of each electron beam.

DETAILED DESCRIPTION OF THE PREFERRED EMBODIMENT

Figure 1:
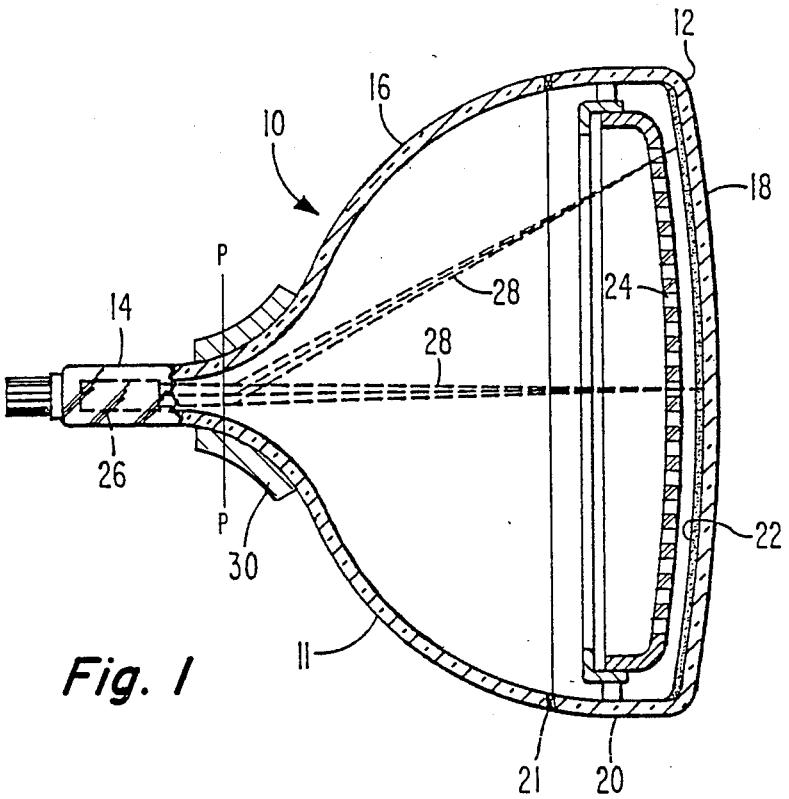
FIG. 1 is a plan view, partly in axial section, of a shadow mask color picture tube embodying the invention.

FIG. 1 shows a rectangular color picture tube 10 having a glass envelope 11 comprising a rectangular faceplate panel 12 and a tubular neck 14 connected by a rectangular funnel 16. The panel 12 comprises a viewing faceplate 18 and a peripheral flange or sidewall 20 which is sealed to the funnel 16 with a frit seal 21. A mosaic three-color phosphor screen 22 is located on the inner surface of the faceplate 18. The screen preferably is a line screen with the phosphor lines extending substantially perpendicular to the high frequency raster line scan of the tube (normal to the plane of FIG. 1). Alternatively, the screen could be a dot screen. A multiapertured color selection electrode or shadow mask 24 is removably mounted, by conventional means, in predetermined spaced relation to the screen 22. An improved inline electron gun 26, shown schematically by dashed lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1 at about the middle of the yoke 30. Because of fringe fields, the zone of deflection of the tube extends axially from the yoke 30 into the region of the gun 26. For simplicity, the actual curvature of the deflection beam paths in the deflection zone is not shown in FIG. 1.

The details of the gun 26 are shown in FIGS. 2, 3, 4, 5 and 6. The gun 26 comprises three equally spaced coplanar cathodes 32 (one for each beam), a control grid electrode 34 (G1), a screen grid electrode 36 (G2), a first einzel lens electrode 38 (G3), a second einzel lens electrode 40 (G4), a third einzel lens electrode 42 (G4') and a fourth einzel lens electrode 44 (G5) spaced in the order named and attached to two support rods 43 (not shown).

The cathodes 32, the G1 electrode 34, the G2 electrode 36 and the side of the G3 electrode 38 facing the G2 electrode 36 comprise the beam forming region of the electron gun 26. The other side of the G3 electrode 38, the G4 electrode 40, the G4' electrode 42 and the G5 electrode 44 comprise the main focusing lens portion of the gun 26. The main focusing lens is a unipotential type, usually called an einzel lens. In this gun, the G3 electrode 38 is electrically connected to the G5 electrode 44, which in turn, is connected to the anode potential. The G4 electrode 40 is either connected to ground or is connected to a low potential compared to the anode potential. The G4' electrode 42 is operated at a modulated potential near that which is applied to the G4 electrode 40.

Each cathode 32 comprises a cathode sleeve 46, closed at the forward end by a cap 48 having an end coating 50 of electron emissive material. Each cathode 32 is indirectly heated by a heater coil positioned within the sleeve 46. The control and screen grid electrodes, 34 and 36, are two closely-spaced flat plates having three pairs of small aligned apertures 65 and 67, respectively, centered with the cathode coatings 50 to initiate three equally-spaced coplanar electron beams 28 extending toward the screen 22. Preferably, the initial electron beam paths are substantially parallel, with the middle path coincident with the central axis A—A.

The G3 electrode 38 is a first einzel lens electrode that includes four portions. A first portion 52 of the first einzel lens electrode 38 is a flat plate having three inline apertures 54 therein with extrusions 55 surrounding the apertures. The first portion 52 is set back from a second portion 56 of the first einzel lens electrode 38. The second portion 56 is cup-shaped, being attached to the first portion at its open end and having a single large aperture 58 in the bottom of the cup through which all three electron beams 28 pass. A third portion 60 of the electrode 38 is a cylindrical section attached to the first portion 52. A fourth portion 62 of the electrode 38 is cup-shaped with its open end attached to the third portion and its bottom having three inline apertures 64 therein.

Figure 2:
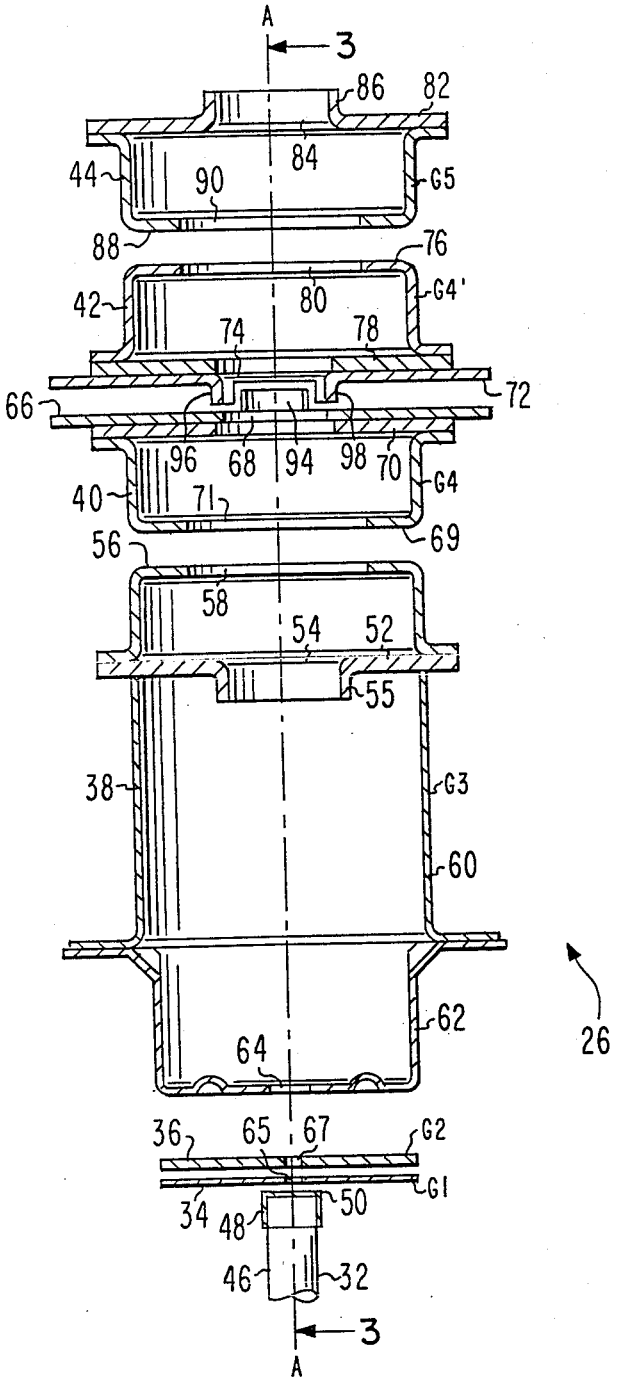
FIGS. 2 and 3 are axial section side and top views, respectively, of the electron gun shown in dashed lines in FIG. 1.
Figure 3:
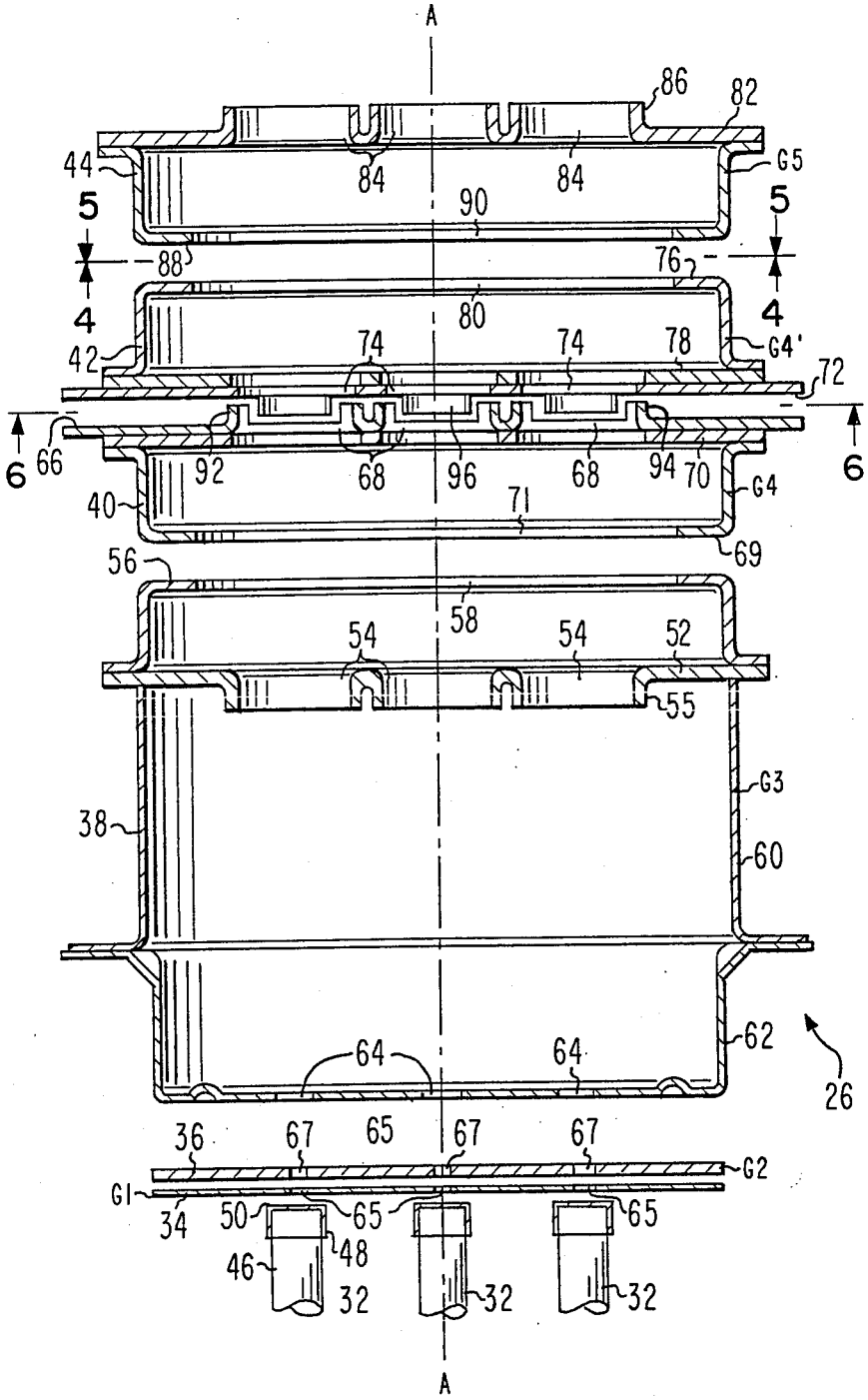

The G4 electrode 40 is a second einzel lens electrode that includes two major portions. A first portion 66 of the second einzel lens electrode 40 is a flat plate having three inline apertures 68 therein. The first portion 66 is set back from a second portion 69 of the second einzel lens electrode 40. The second portion 69 may be attached directly to the first portion 66 or may be attached through an apertured intermediate plate 70, as shown in FIGS. 2 and 3. The second portion 69 is cup-shaped being attached to the intermediate portion 70 at its open end and having a single large aperture 71 in the bottom of the cup through which all three electron beams pass.

The G4' electrode 42 is a third einzel lens electrode that includes two major portions. A first portion 72 of the third einzel lens electrode 42 is a flat plate having three inline apertures 74 therein. The first portion 72 is set back from a second portion 76 of the third einzel lens electrode 42. The second portion 76 may be attached directly to the first portion 72 or may be attached through an apertured intermediate plate 78, as shown in FIGS. 2 and 3. The second portion 76 is cup-shaped being attached to the intermediate portion 78 at its open end and having a single large aperture 80 in the bottom of the cup through which all three electron beams pass.

The G5 electrode 44 is a fourth einzel lens electrode that includes two portions. A first portion 82 of the fourth einzel lens electrode 44 is a flat plate having three inline apertures 84 therein with extrusions 86 surrounding the apertures. The first portion 82 is set back from a second portion 88 of the fourth einzel lens electrode 44. The second portion 88 is cup-shaped being attached to the first portion 82 at its open end and having a single large aperture 90 in the bottom of the cup through which all three electron beams pass.

Figure 4:
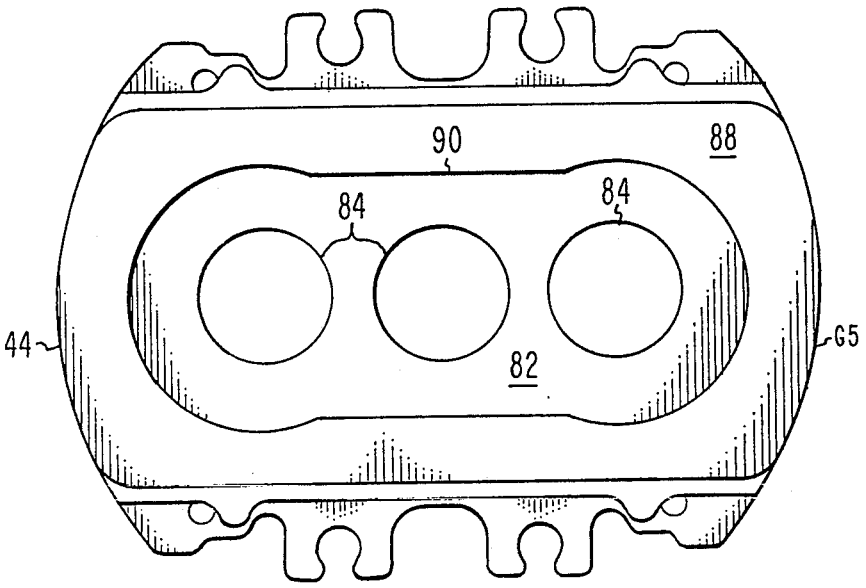
FIG. 4 is a sectional view of an electrode of the electron gun taken at line 4—4 of FIG. 3.

The shape of the large aperture 90 in the second portion 88 of the G5 electrode 44 is shown in FIG. 4. The aperture 90 is vertically wider at the side electron beam paths than it is at the center beam path. Such shape has been referred to as the "dogbone" or "barbell" shape. The shape of the large aperture 58 in the second portion 56 of the G3 electrode 38 is similar to that of the aperture 90.

Figure 5:
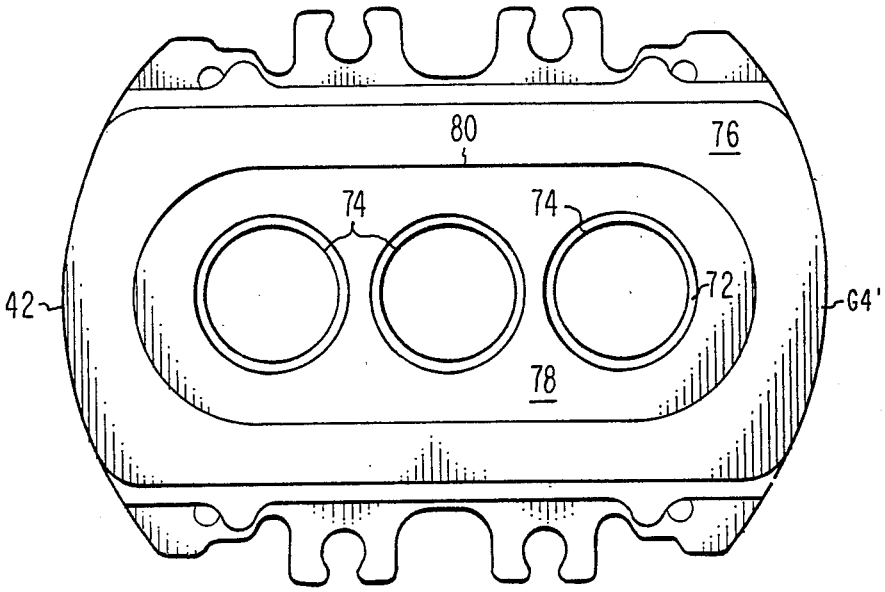
FIG. 5 is a sectional view of an electrode of the electron gun taken at line 5—5 of FIG. 3.

The shape of the large aperture 80 in the second portion 76 of the G4' electrode 42 is shown in FIG. 5. This aperture 80 has a uniform vertical width at each of the electron beam paths with rounded ends. Such shape has been referred to as the "racetrack" shape. The shape of the large aperture 71 in the second portion 69 of the G4 electrode 40 is similar to that of the aperture 80.

Figure 6:
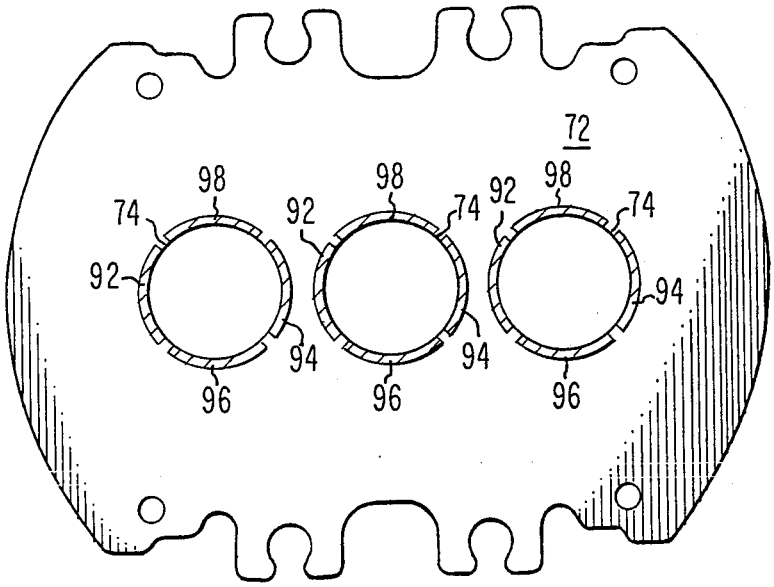
FIG. 6 is a sectional view of the electron gun taken at line 6—6 of FIG. 3.

The first portion 66 of the G4 electrode 40 faces the first portion 72 of the G4' electrode 42. The apertures 68 in the first portion 66 of the G4 electrode 40 have extrusions extending therefrom that have been divided into two segments 92 and 94 for each aperture. The apertures 74 of the first portion 72 of the G4' electrode 42 also have extrusions extending therefrom that have been divided into two segments 96 and 98 for each aperture. As shown in FIG. 6, the segments 92 and 94 are interleaved with the segments 96 and 98. These segments are used to create quadrupole lenses in the paths of each electron beam when different potentials are applied to the G4 electrode 40 and the G4' electrode 42. By proper application of a modulated voltage differential to either the G4 electrode 40 or the G4' electrode 42, it is possible to use the quadrupole lenses established by the segments 92, 94, 96 and 98 to provide an astigmatic correction to the electron beams to compensate for astigmatisms occurring in either the electron gun or in the deflection yoke.

Test Results

A 13V90 (33 cm diagonal with 90° maximum deflection) color picture tube was constructed having the einzel lens electron gun 26 therein. Specific dimensions for the electron gun 26 are presented in the following TABLE.

TABLE

| | inches | mm |
|---|---|---|
| Thickness of G1 electrode 34 | 0.004 | 0.102 |
| G1 and G2 aperture diameter | 0.025 | |
| G1 to G2 spacing | 0.010 | 0.254 |
| Thickness of G2 electrode 36 | 0.012 | 0.305 |
| G2 to G3 spacing | 0.120 | 3.048 |
| Length of G3 electrode 38 | 0.775 | 19.685 |
| G3 aperture 64 diameter | 0.060 | |
| G3 to G4 spacing | 0.050 | 1.270 |
| Length of G4 and G4' electrodes 40 and 42 | 0.390 | 9.906 |
| G4' to G5 spacing | 0.050 | 1.270 |

TABLE-continued

| | inches | mm |
|---|---|---|
| Length of G5 electrode 44 | 0.160 | 4.064 |
| Length of apertures 71 and 80 | 0.720 | 18.288 |
| Width of apertures 71 and 80 | 0.335 | 8.509 |
| Diameter of apertures 55, 68, 74 and 84 | 0.160 | 4.064 |
| Center-to-center spacing of apertures 55, 68, 74 and 84 | 0.200 | 5.080 |
| Length of extrusions in G3, G4, G4' and G5 | 0.020 | 0.508 |
| Length of apertures 58 and 90 | 0.683 | 17.348 |
| Maximum width of apertures 58 and 90 | 0.290 | 7.366 |
| Minimum width of apertures 58 and 90 | 0.279 | 7.087 |

Figure 7:
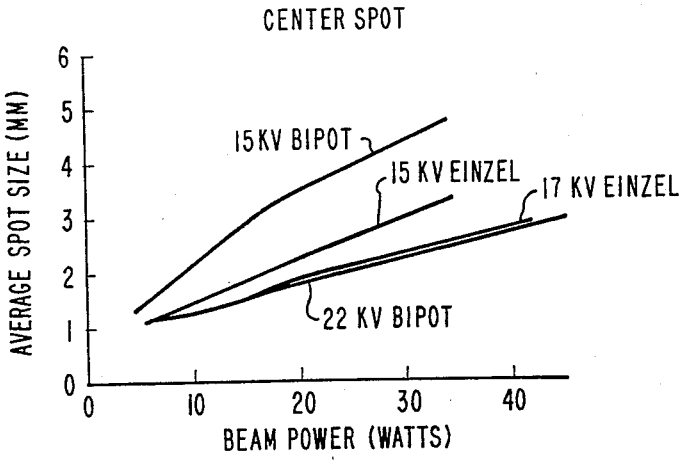
FIGS. 7 and 8 are graphs showing the relationships of the electron beam spot size at the center and corners, respectively, of a screen versus beam power.
Figure 8:
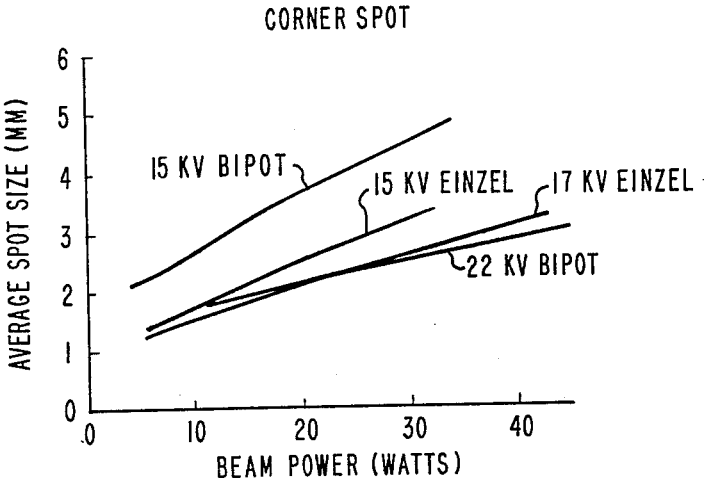

The novel tube was compared with a commercial 13V90 color picture tube having a bipotential electron gun. Electron beam spot size measurements were taken on both tubes at the centers and at the corners of their respective screens. The results of these tests are shown in the graphs of FIGS. 7 and 8. Data was taken on the commercial tube at 22 kV, its normal operating voltage, and at 15 kV to establish the performance difference of the tube at high and low voltages. Data was then taken on the novel tube having the einzel lens electron gun 26 therein. First, the novel tube was operated at an anode voltage of 15 kV. Performance of the novel tube at 15 kV was between that of the commerical tube operated at 15 kV and 22 kV. The anode voltage on the novel tube was raised until performance of the novel tube substantially equalled that of the commercial tube when operated at 22 kV. Such substantially equal performance was reached at an anode voltage of 17 kV.

What is claimed is:

1. In a color picture tube including a neck, a funnel and a faceplate and having an inline electron gun in said neck for generating and directing three inline electron beams, a center beam and two side beams, along initially coplanar paths toward a screen of said tube, said gun including a plurality of spaced electrodes which form a main focus lens for focusing said electron beams, the improvement comprising said plurality of spaced electrodes which form a main focus lens including four electrodes that form an einzel lens in the path of each electron beam, a first of the einzel lens electrodes includes a first portion having three inline apertures that are set back from a second portion of the first einzel lens electrode having a single large aperture through which all three electron beams pass, a second of the einzel lens electrodes includes a first portion having three inline apertures that are set back from a second portion of the second einzel lens electrode having a single large aperture through which all three electron beams pass, the second portion of the first einzel lens electrode facing the second portion of the second einzel lens electrode, a third of the einzel lens electrodes includes a first portion having three inline apertures that are set back from a second portion of the third einzel lens electrode having a single large aperture through which all three electron beams pass, a fourth of the einzel lens electrodes includes a first portion having three inline apertures that are set back from a second portion of the fourth einzel lens electrode having a single large aperture through which all three electron beams pass, the second portion of the third einzel lens electrode facing the second portion of the fourth einzel lens electrode, the first portion of the second einzel lens electrode facing the first portion of the third einzel lens electrode, and the first portion of the second einzel lens electrode and the first portion of the third einzel lens electrode including means for forming a quadrupole lens in the path of each electron beam therebetween.

* * * * *